US005549377A

United States Patent [19]

Krivec

[11] Patent Number: 5,549,377

[45] Date of Patent: Aug. 27, 1996

[54] CORRUGATED THREE-PIECE DRAWER SLIDE ASSEMBLY

[75] Inventor: Bert Krivec, Waukesha, Wis.

[73] Assignee: Snap-on Technologies, Inc., Crystal Lake, Ill.

[21] Appl. No.: 488,763

[22] Filed: Jun. 8, 1995

[51] Int. Cl.[6] ..... A47B 88/00

[52] U.S. Cl. ..... 312/334.8; 312/334.16

[58] Field of Search ..... 312/330.1, 334.4, 312/334.5, 334.7, 334.8, 334.16, 332

[56] References Cited

U.S. PATENT DOCUMENTS

| | | | |
|---|---|---|---|
| 113,871 | 4/1871 | Gibbons . | |
| 869,735 | 10/1907 | Rubin . | |
| 1,318,919 | 10/1919 | Probsi . | |
| 2,627,447 | 2/1953 | Cook . | |
| 2,664,334 | 12/1953 | Bissman | 312/332 |
| 2,865,684 | 12/1958 | Meyer et al. . | |
| 3,355,232 | 11/1967 | Blake | 312/334.8 |
| 3,586,394 | 6/1971 | Hecksel . | |
| 3,927,918 | 12/1975 | Dobbratz . | |
| 4,047,767 | 9/1977 | Foust . | |
| 4,440,461 | 4/1984 | Powell et al. . | |
| 4,606,588 | 8/1986 | Koch . | |
| 4,681,381 | 7/1987 | Sevey . | |
| 4,712,927 | 12/1987 | Arrendiell et al. . | |
| 4,752,143 | 6/1988 | Lautenschlager . | |
| 4,759,341 | 7/1988 | McFarland . | |
| 5,046,861 | 9/1991 | Tarver . | |
| 5,255,983 | 10/1993 | Parvin . | |

FOREIGN PATENT DOCUMENTS

| | | | |
|---|---|---|---|
| 0288066 | 5/1953 | Switzerland | 312/334.8 |

OTHER PUBLICATIONS

NASA Tech Briefs, Spring 1980, vol. 5, No. 1, pp. 107.

*Primary Examiner*—Peter M. Cuomo
*Assistant Examiner*—Gerald A. Anderson
*Attorney, Agent, or Firm*—Emrich & Dithmar

[57] ABSTRACT

A low-cost, low-noise, and low-weight, high strength three-piece slide assembly is provided for use with cabinet drawers. The slide assembly includes a corrugated drawer-side member having a first corrugated surface with elongated corrugations having a first extending longitudinal axis parallel to the direction of drawer travel, and a cabinet-side member having a second corrugated surface with second corrugations extending parallel to the longitudinal axis. Also included is a corrugated intermediate member sized and shaped for sliding movement between the drawer-side and the cabinet-side members. The intermediate member includes a drawer-facing surface having third corrugations, and a cabinet-wall-facing surface having fourth corrugations. The third and fourth corrugations are respectively mateably engageable with the first and second corrugations. The third corrugations extend substantially equidistantly from opposite sides of a first medial plane and said fourth corrugations extend substantially equidistantly from opposite sides of a second medial plane, where the first and second medial planes are inclined with respect to each other. In an alternative embodiment, the intermediate piece is a steel element coated with a low coefficient of friction material and has a body with generally v-shaped corrugations sized and shaped for mateable sliding movement between similarly corrugated surfaces on the drawer-side and the cabinet-side members.

20 Claims, 6 Drawing Sheets

CORRUGATED THREE-PIECE DRAWER SLIDE ASSEMBLY

BACKGROUND OF THE INVENTION

1. Field of the Invention

The present invention relates generally to drawer slides and, more specifically, to three-piece drawer slide assemblies having a unique corrugated geometry capable of use in cabinets housing a variety of drawers of different depths.

2. Description of the Prior Art

Drawer slide assemblies for slidably supporting a drawer to allow the drawer to slide into and out of a cabinet, chest or other piece of furniture between closed and open conditions frequently have a three-piece construction. Such an assembly includes a drawer-side slide member connected to a drawer, a cabinet-side slide member connected to the frame of the cabinet and an intermediate piece slidably coupled to the drawer and cabinet members. Slide assemblies could be very complex, such as ball bearing assemblies, which have numerous intricate parts and are normally used for drawers intended to support very heavy loads.

Slide assemblies are also known which are quite simple in construction consisting only of three discrete pieces (hereinafter, 'one-piece slide assemblies'), namely a cabinet side slide member, a drawer-side slide member and an intermediate piece. However, construction of conventional one-piece slide assemblies does not lend itself to use with drawers intended to support very heavy loads. It would be an advancement in the prior art, therefore, to provide a one-piece slide assembly which is durable, simple in construction, low in cost, low in noise and weight, and dimensioned to avoid side play of a drawer during travel.

Most commonly, three-piece slides are generally of simple construction and used in cabinets equipped with a fixed configuration of drawers. Consumers, in the past, therefore, have been limited in buying storage cabinets equipped with only one configuration of storage drawers. This has caused them to conduct lengthy searches to find the exact storage device to fit their precise needs or has not allowed them to store their belongings in the manner that they desired. Further, if their storage needs change, they are either forced to buy an entire new cabinet or attempt to rearrange their belongings in their current cabinet.

Though there are now available some modular storage cabinets for housing interchangeable and differently-sized drawers, they are constructed with intricate multi-part cabinet and drawer guides and slides. This multi-part intricate design is time-consuming and costly to construct and manufacture.

SUMMARY OF THE INVENTION

It is a general object of the present invention to provide a drawer slide assembly which is of simple construction, and is economical and easy to assemble.

It is another object of the present invention to provide a drawer slide assembly consisting essentially of three discrete pieces and constructed of very durable, low-weight and low-noise material.

Another feature of the present invention is the provision of a drawer slide assembly which allows a wide variety of interchangeable configurations of drawers of different depths to be utilized in a single cabinet.

These and other features of the invention are attained by providing a slide assembly provided for use with cabinet drawers. The slide assembly includes a corrugated drawer-side member having a first corrugated surface with elongated corrugations having a first extending longitudinal axis parallel to the direction of drawer travel, and a cabinet-side member having a second corrugated surface with second corrugations extending parallel to the longitudinal axis. Also included is a corrugated intermediate member sized and shaped for sliding movement between the drawer-side and the cabinet-side members. The intermediate member includes a drawer-facing surface having third corrugations, and a cabinet-wall-facing surface having fourth corrugations. The third and fourth corrugations are respectively mateably engageable with the first and second corrugations. The third corrugations extend substantially equidistantly from opposite sides of a medial first plane and said fourth corrugations extend substantially equidistantly from opposite sides of a second medial plane, where the first and second medial planes are inclined with respect to each other.

In an alternative embodiment, the intermediate piece is a steel element coated with a low coefficient of friction material and has a body with generally v-shaped corrugations sized and shaped for mateable sliding movement between similarly corrugated surfaces on the drawer-side and the cabinet-side members.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
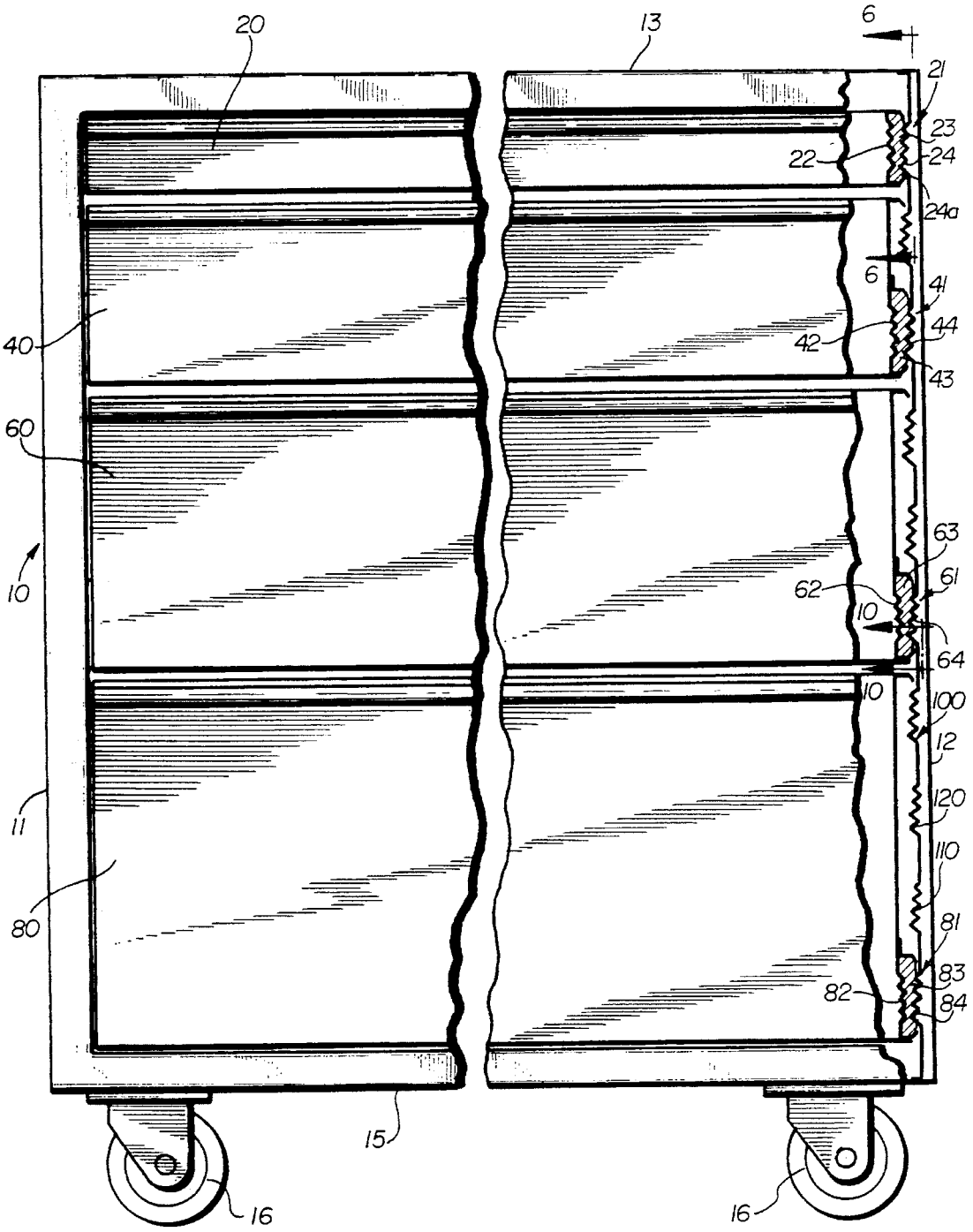
FIG. 1 is a front elevation view of a tool cabinet having variously sized drawers fitted therein, partially broken away to show the drawer slide assemblies, the latter constructed in accordance with and embodying the features of the present invention.

Referring to FIG. 1, there is illustrated a tool cabinet 10 consisting of left and right-side walls 11, 12, a top wall 13, a rear wall 14 (see FIG. 6) and a bottom wall 15, on the underside of which are coupled casters 16. The five walls 11–15 define a front opening in which are shown inserted four drawers 20, 40, 60, and 80 of various depths. In the illustrative embodiment, drawers 20, 40, 60 and 80 correspond to a two-inch, a four-inch, a six-inch and an eight-inch drawer. The drawers are respectively disposed within the cabinet 10 by way of four pairs of corresponding drawer slide assemblies 21, 41, 61 and 81, disposed on either side of the associated drawer and constructed in accordance with and embodying the features of the present invention. The slide assemblies 21, 41, 61, and 81 are essentially of identical three-part construction and include corresponding pairs of left (see FIG. 2) and right drawer-side members 22, 42, 62, 82, corresponding pairs of left and right intermediate members 23, 43, 63, 83 and corresponding pairs of left and right cabinet-side member portions 24, 44, 64, 84, with the portions 24, 44, 64 and 84 formed unitarily with a blind wall 100 on the inside of each of the left and right cabinet side walls 11, 12.

It should be understood that the cabinet 10 is shown only for illustrative purposes and that the slide assemblies 21, 41, 61, 81, to be described below in connection with the present invention, could easily be modified as necessary to accommodate cabinets of various length, height, thickness and drawer configuration.

Figure 2:
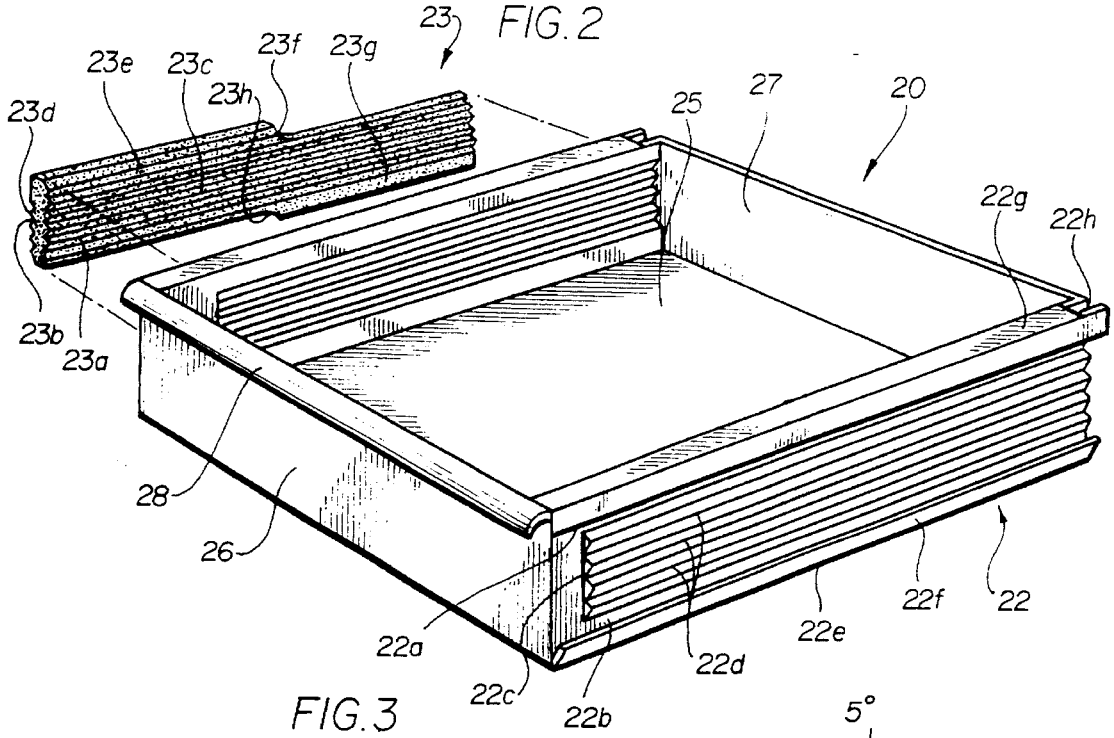
FIG. 2 is a perspective view of one of the drawers shown in FIG. 1, with the intermediate member of its left-side drawer slide assembly shown in exploded view.
Figure 9:
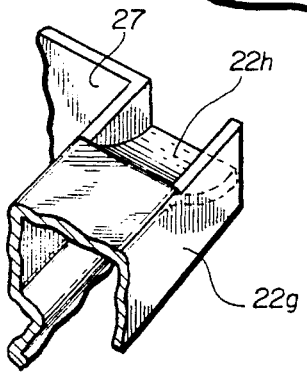
FIG. 9 is an enlarged, fragmentary, perspective view of the tab portion on the rear of the drawer-side member of FIGS. 6–8.

The general construction of the drawers 20, 40, 60, and 80 will now be described by way of exemplary FIG. 2 showing, in greater detail, the two-inch drawer 20. Drawers 40, 60 and 80 are essentially identical to drawer 20 except for their depths. Drawer 20 is of generally rectangular shape and consists of a unitarily formed flat base 25, and same-height forward and rear walls 26, 27, respectively. The base 25 and walls 26, 27 are generally planar with the exception of a finger gripping flange 28 on the topmost portion of forward wall 26, provided to facilitate grasping the drawer 20 for sliding between its closed and open conditions. Attached to the flat base 25, by welding or other suitable means, are the right and left side walls of the drawer 20, which side walls respectively include the drawer-side members 22 of the associated drawer sliding assembly 21. The drawer-side members 22 are elongated walls, each including a top flat surface portion **22*a* and a bottom flat surface portion 22*b*, separated by a corrugated portion 22*c* defined by a number of v-shaped corrugations 22*d* extending longitudinally substantially the length of the drawer-side member 22. The member 22 has a generally flat horizontal bottom surface 22*e* from which extends an upwardly inclined flange or lip 22*f*. A laterally outwardly extending flange 22*g* is also provided at the top of the drawer-side member 22. At the rear end of flange 22*g* is provided an intermediate-member-engaging tab portion 22*h* projected downwardly, as can be seen in FIG. 9. The drawer-side member elements 22*a*–22*h* are shaped and sized to matingly receive the associated intermediate member 23**, as will be described below.

The intermediate member 23 has a drawer-facing surface **23*a* and a cabinet-facing surface 23*b*, respectively including v-shaped, longitudinally extending corrugations 23*c*, 23*d* sized for mating engagement with corrugations 22*d* on the drawer-side member 22 and with corrugations 24*a* defining the cabinet-side member portion 24 (see FIG. 1). The cabinet-facing surface 23*b* is slightly inclined (approximately five degrees) relative to the drawer-facing surface 23*a*, so that the member 23 is thicker along the top thereof than along the bottom thereof to provide added strength and prevent side play of the drawer 20 as it is slid forwardly and rearwardly. The corrugations 24*a* of cabinet-side member portion 24 are similarly inclined to mate with the inclined corrugations 23*d* on the cabinet side surface 23*b*, as in FIG. 3** which illustrates a similarly configured four-inch drawer.

The intermediate member 23 also includes a top surface **23*e* which is stepped down intermediate its front and rear ends to define a rearward-facing stop surface 23*f*. Similarly, the intermediate member 23 includes a bottom surface 23*g* which is stepped down intermediate its front and rear ends to define a forward-facing stop surface 23*h***.

Figure 3:
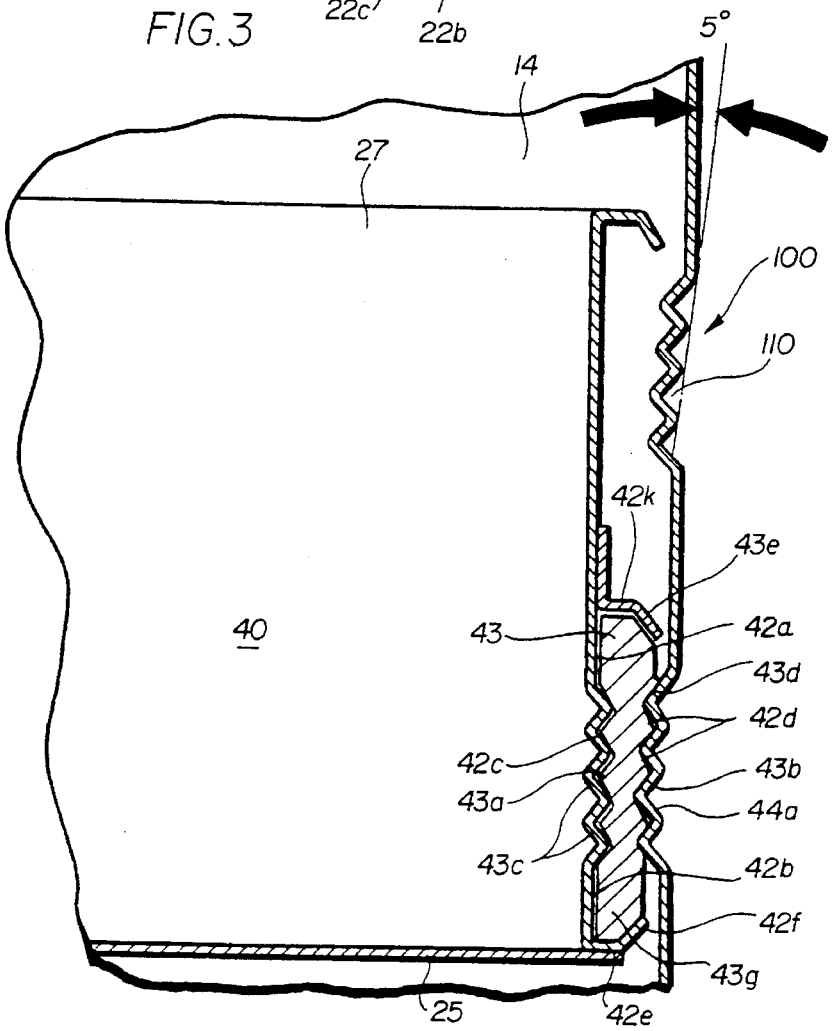
FIG. 3 is an enlarged, fragmentary, vertical sectional view of a portion of FIG.1 illustrating the right-side slide assembly of the four-inch drawer.

The geometry of the slide assembly 41 of drawer 40 is shown in FIG. 3 and substantially identical to that of the slide assembly 21 of drawer 22. Thus similar parts bear similar reference characters in the forty series.

As can be seen from FIGS. 1 and 3, the cabinet blind wall 100 includes plural spaced-apart corrugated portions, 24, 44, 64, 84, 110, 120, with corrugated portions 24, 44, 64, 84 constituting the cabinet-side member portions of associated drawer slide assemblies 21, 41, 61, 81. The plural corrugated portions 24, 44, etc. on blind wall 100 allow a wide variety of different sized drawers to be accommodated within the cabinet 10. In the illustrative embodiment, a 20-inch drawer-space cabinet is shown provided with a 2-inch (20), a 4-inch (40), a 6-inch (60), and an 8-inch (80) drawer (see FIG. 1). Unused corrugations, such as 110, 120, make it possible to interchange or rearrange the drawers in an alternative preferred manner, for example, interchanging the positions of the 8-inch drawer (80) and the 6 inch drawer (60). Toward this end, the modular nature of cabinet 10 facilitates not only interchanging available drawers, but also permits replacing available drawers with drawers of different sizes. For example, the 8-inch drawer (80) of cabinet 10 could be replaced with two 4-inch drawers (40), or with four 2-inch drawers (20), or with one 6-inch drawer (60) and a 2-inch drawer (20).

It should be appreciated that the present invention also has application to non-modular cabinets, such as cabinets having only a single, predetermined size drawer requiring only one cabinet-side member side portion 21 formed on the cabinet wall 100. It should further be appreciated that the cabinet could be provided with a similarly corrugated elongated body which is welded or otherwise suitably attached to the side wall of a cabinet.

Figure 4:
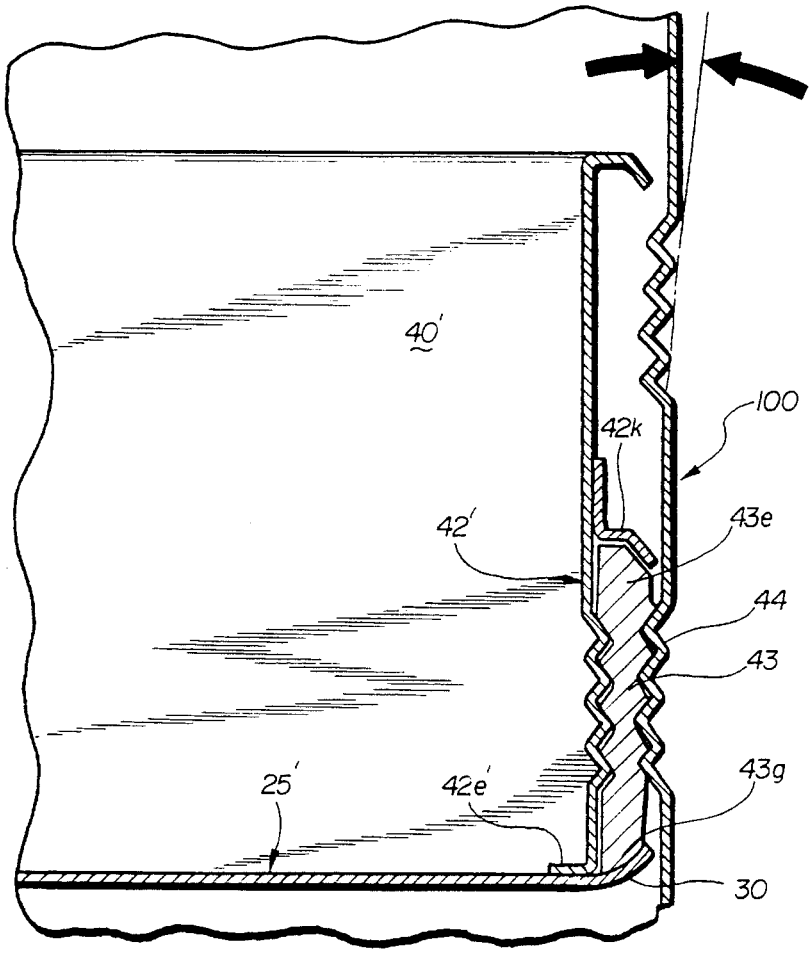
FIG. 4 is a view similar to FIG. 3 but showing an alternative construction wherein the bottom wall of the drawer has an upwardly flanged outer edge.

In an alternative embodiment shown in FIG. 4, a drawer 40' includes a drawer-side member 42' the bottom portion **42*e*' of which has its end surface bent inwardly and attached by welding or other suitable manner to a base 25' of the drawer 40'. The base 25' includes ends 30 which flange upwardly to receive the bottom complementary-shaped portion 43*g* of the corrugated intermediate slide 43**.

In both FIGS. 3 and 4, the drawers 40 and 40' have a depth greater than the vertical length of the associated intermediate member 43. Consequently, an extra flange portion **42*k* is provided to engage the top portion 43*e* of intermediate member 43**.

Figure 5:
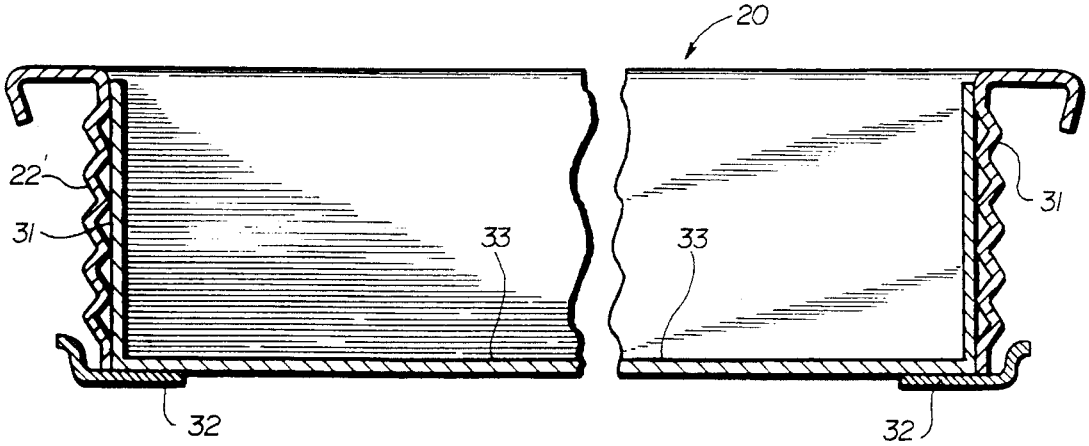
FIG 5 is a sectional view of a drawer similar to that of FIG. 2 but showing the drawer-side member attached to a flat side surface of the drawer.

In yet another embodiment shown in FIG.5, a four-walled, flat-sided two-inch drawer 20' is provided with the corresponding left and right drawer-side members 22' attached, by welding or the like, to the outer side surfaces 31 and to the extended corners 32 attached to base 33 of the drawer 20' or by an extension to the base 33 similar to the construction shown in FIG. 4. The corrugated construction of the drawer-side member 22' is otherwise the same as that of drawer-side member 22 in FIG. 2.

Figure 6:
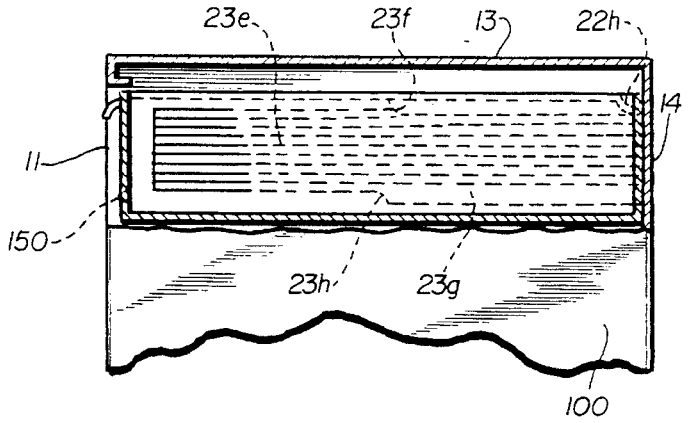
FIG. 6 is an enlarged, fragmentary, right-side sectional view taken generally along the line 6—6 in FIG. 1.

The sliding operation of the slide assemblies disclosed herein will now generally be described with reference to FIGS. 6–9. FIG. 6 shows the drawer 20 in its fully closed position.

Figure 7:
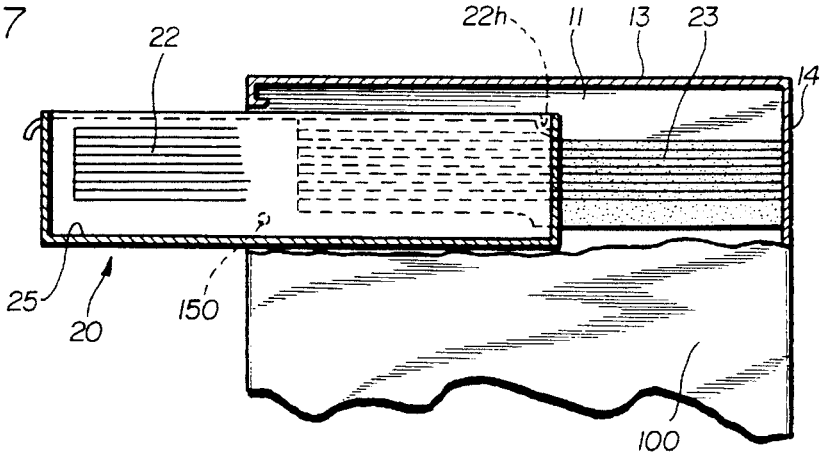
FIG. 7 is a view similar to FIG. 6, but showing the drawer slid forwardly with a tab portion on the rear of the drawer-side member engaging a stop surface on the intermediate member for movement therewith.
Figure 8:
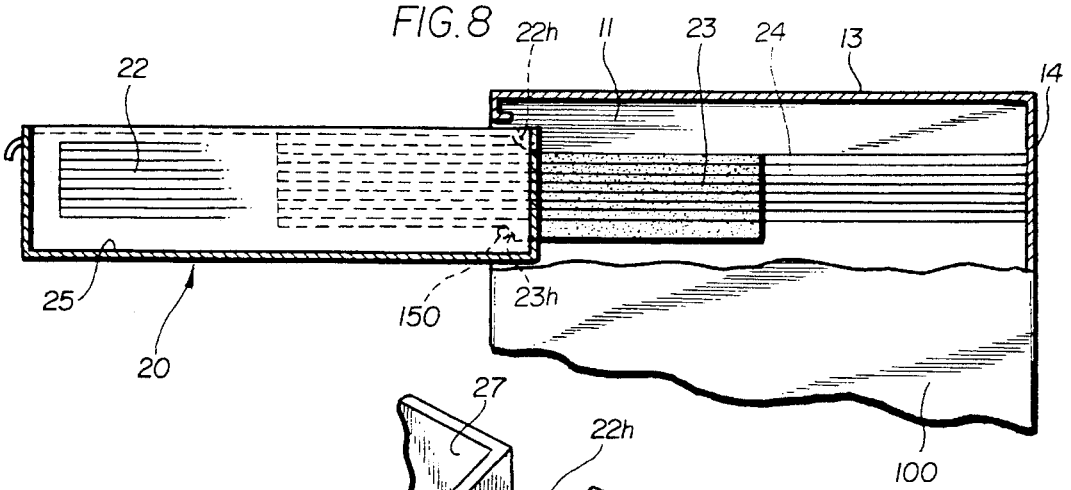
FIG. 8 is a view similar to FIGS. 6 and 7, but showing the drawer in the fully extended position with the intermediate member engaged with a stopper disposed on the cabinet-side member.

In FIG. 7, the drawer 20 is shown slid outwardly with the tab portion **22*h* (see FIG. 9) of drawer-side member 22 making contact against the rearward-facing stop surface 23f on the top surface 23*e* of intermediate member 23. As the drawer is slid further outwardly, the drawer-side member 22 travels together with the intermediate member 23 and is supported thereby. FIG. 8 shows the drawer 20 and the drawer-side member 22 in the fully extended or open condition. In this condition, the forward-facing stop surface 23*h* on the bottom surface 23*g* engages a stopper 150 disposed near the front end of the cabinet 10 on the cabinet-side member 24, as seen more clearly in FIGS. 10–12**.

Figure 10:
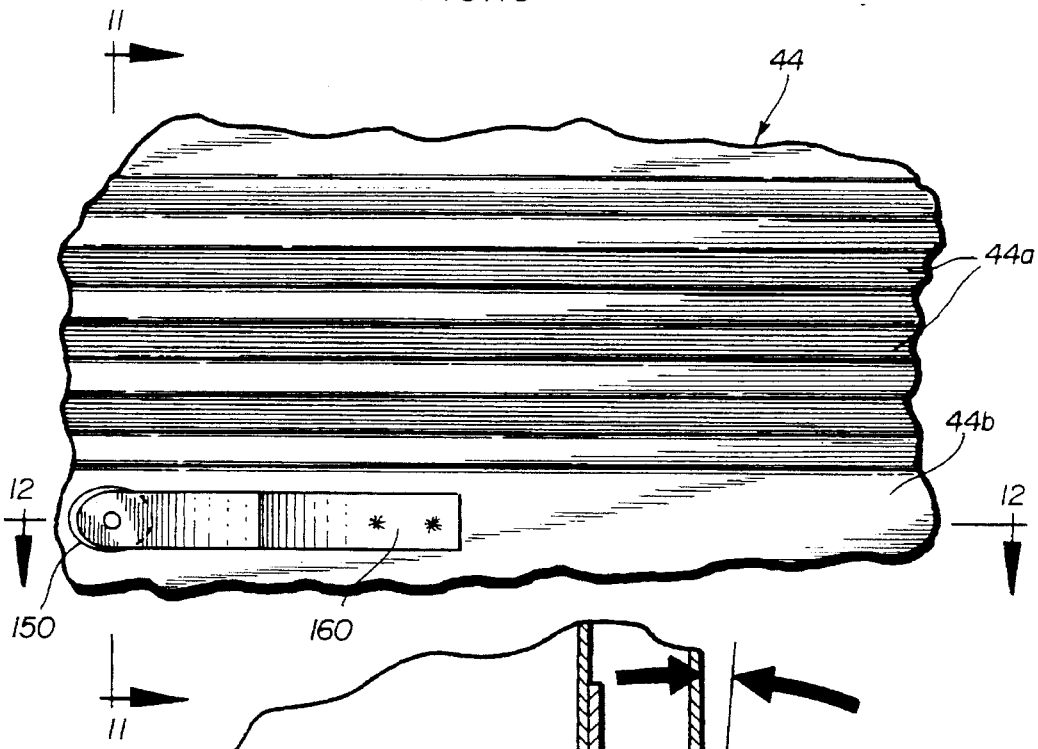
FIG. 10 is an enlarged, fragmentary, right-side sectional view taken generally along the line 10—10 in FIG. 1, showing the stopper connected to the portion of the cabinet-side member near the front of the cabinet.
Figure 11:
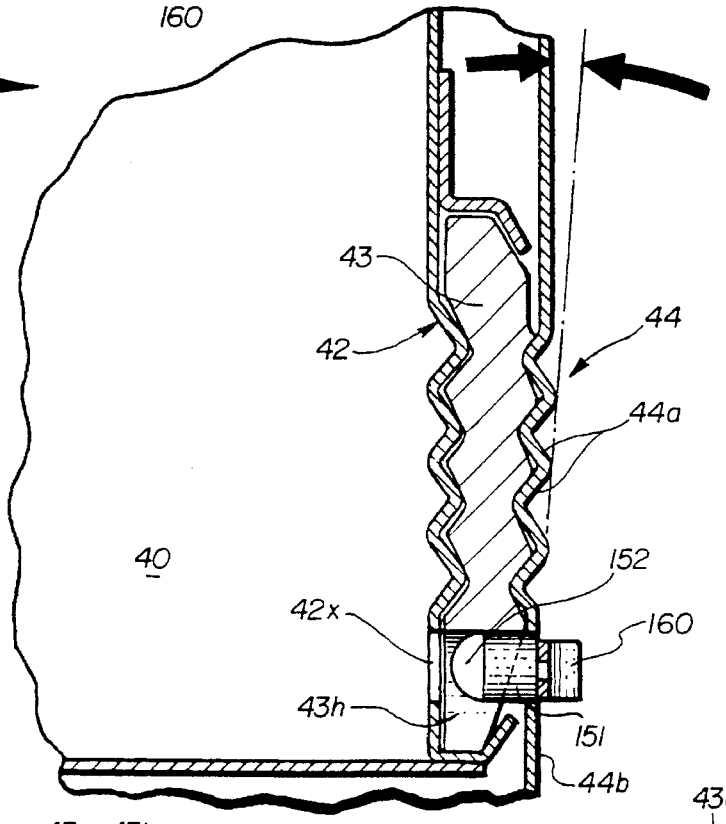
FIG. 11 is an enlarged, fragmentary, vertical sectional view taken generally along the line 11—11 in FIG. 10.
Figure 12:
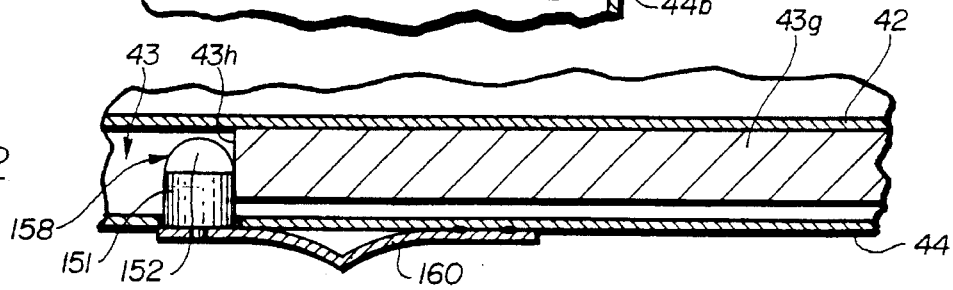
FIG. 12 is a fragmentary, horizontal sectional view taken generally along the line 12—12 in FIG. 10.

Referring now to FIGS. 10–12, the stopper 150 is shown connected to a bent leaf spring 160 by way of a rivet or other suitable means and includes a circularly cylindrical lower portion 151 and a hemispherical upper portion 152. The bent leaf spring 160 biases the stopper 150 laterally to effect the engagement thereof with the forwardly-facing stop surface **43*h* as the intermediate member 43 is slid forwardly by the outwardly moving drawer-side member 42 on the drawer 40. The leaf spring 160 is connected to the non-corrugated surface 44*b* adjacent the corrugated surface 44*a* on the cabinet-side member portion 44 by suitable adhesive or mechanical means, preferably welded thereon. Stopper 150 stops the drawer 40 and prevents inadvertent removal but must also function to allow release of the drawer and removal when desired. Accordingly, a hole 42× (FIG. 11) is provided on the drawer-side member 42 to allow deflection of the stopper 150** in the lateral-outward direction to effect drawer removal.

The corrugated intermediate members 23, 43, 63, 83 are preferably made of a low coefficient of friction material such as Teflon® or molybdenum disulphide impregnated polyurethane or other suitable plastic material which is low-noise, low-weight, and high in strength, to accommodate use of the slide assemblies in high-load environments.

Figure 13:
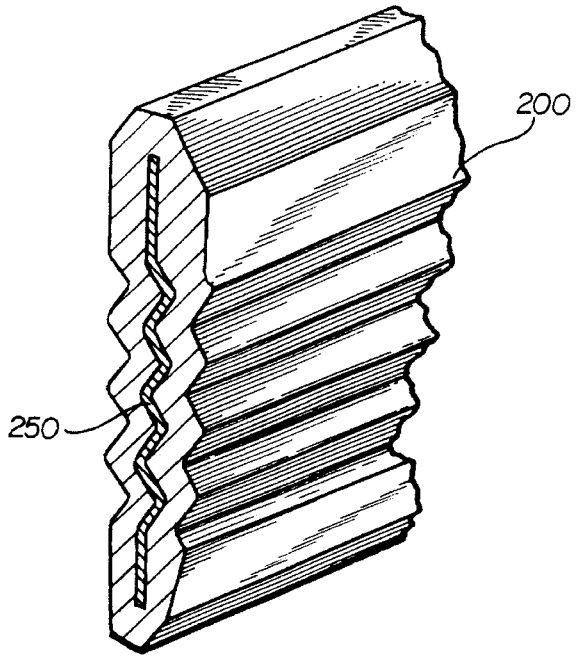
FIG. 13 is a fragmentary, perspective view of an intermediate member having a steel core reinforcement element.

FIG. 13 shows an alternative construction of an intermediate member 200 having a shape generally substantially similar to intermediate member 23 and made of the same material, but having a steel core corrugated reinforcement 250 which is very strong and can be used in most high-load environments.

Figure 14:
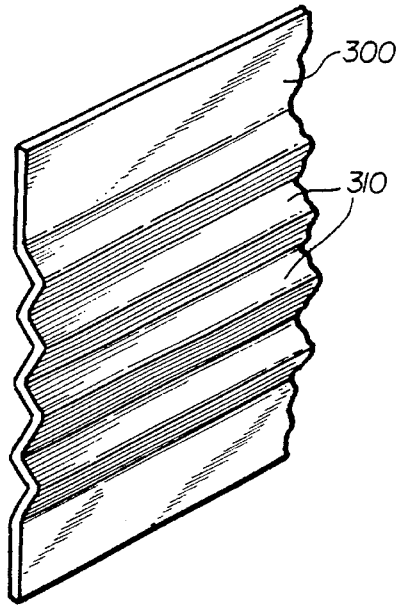
FIG. 14 is a fragmentary, perspective view of an alternative construction of an intermediate member made from steel.
Figure 15:
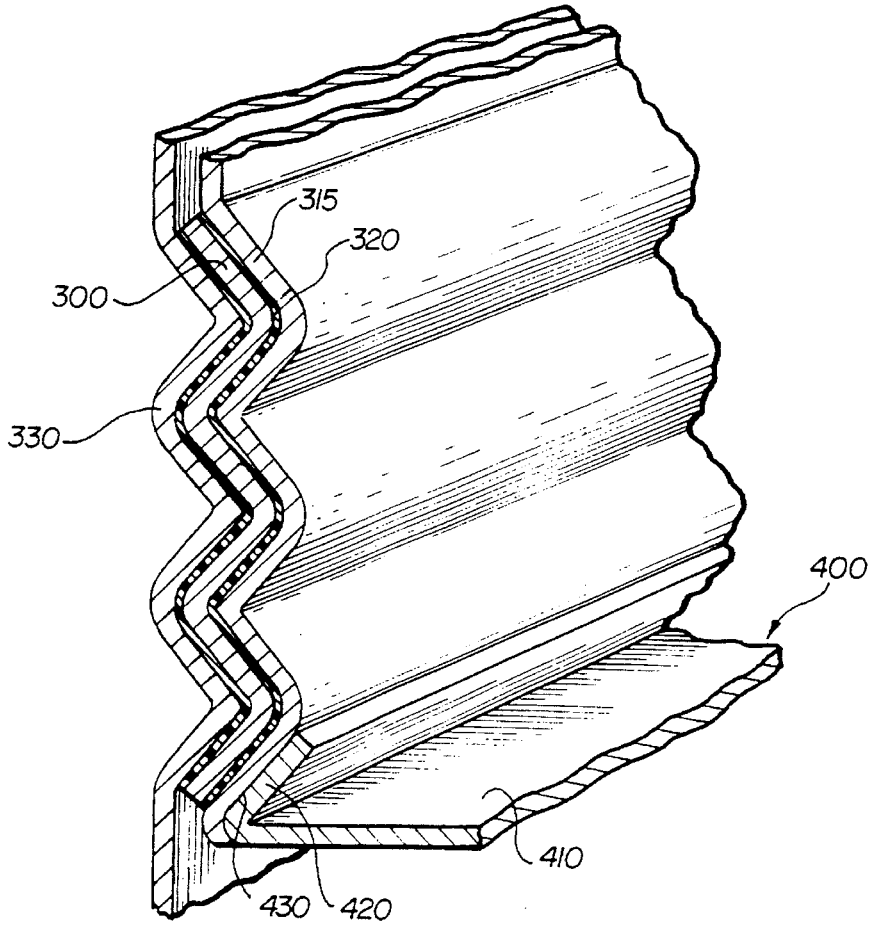
FIG. 15 is an enlarged, fragmentary, perspective view of a drawer slide assembly incorporating the intermediate member of FIG. 14.

FIG. 14 shows yet another alternative construction of an intermediate member 300 consisting of a steel core corrugated member of very simple construction and including plural v-shaped corrugations 310. Prior to assembly, the steel core member 300 is coated with a suitable low coefficient of friction material 315 (see FIG. 15). Similarly corrugated drawer-side and cabinet side members 320, 330, respectively, are disposed on either side of the coated steel core member 300 resulting in a very high-strength, highly durable slide assembly. In the illustrated construction, the drawer-side member 320 constitutes the side wall of a drawer 400 having a base 410 with an inwardly inclined flange 420 coupled to a bottom planar portion 430 of the drawer-side member 320.

While particular embodiments and several specific forms of tools of the present invention have been shown and described, it will be appreciated by those skilled in the art that additional changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A slide assembly for supporting a drawer in a cabinet comprising:

a corrugated drawer-side member including a first corrugated surface having first elongated corrugations having a longitudinal axis parallel to the direction of drawer travel;

a cabinet-side member including a second corrugated surface having second corrugations extending parallel to said longitudinal axis; and a corrugated intermediate member sized and shaped for sliding movement between said drawer-side and said cabinet-side members, said intermediate member having a drawer-facing surface including third corrugations and a cabinet-wall-facing surface including fourth corrugations, said third and fourth corrugations being respectively mateably engageable with said first and second corrugations, wherein said third corrugations extend substantially equidistantly from opposite sides of a first medial plane and said fourth corrugations extend substantially equidistantly from opposite sides of a second medial plane, said first and second medial planes being inclined with respect to each other.

2. The slide assembly of claim 1, wherein said second corrugated surface is disposed on a wall of a cabinet.

3. The slide assembly of claim 1, wherein said drawer-side member is one side of a drawer.

4. The slide assembly of claim 1, wherein said drawer-side member is one side of a drawer and includes a flange disposed to mateably receive a lowermost portion of said intermediate member.

5. The slide assembly of claim 1, wherein said drawer-side member is one side of a drawer, the drawer including a laterally projecting flange adjacent to said drawer-side member and disposed to mateably receive a lowermost portion of said intermediate member.

6. The slide assembly of claim 1, wherein said intermediate member is made of a low coefficient of friction material.

7. The slide assembly of claim 1, wherein said intermediate member is made of a plastic material.

8. The slide assembly of claim 7, wherein said plastic material includes molybdenum disulphide impregnated polyurethane and Teflon®.

9. The slide assembly of claim 1, wherein said first, second, third, and fourth corrugations are generally v-shaped.

10. The slide assembly of claim 1, wherein said intermediate member is made of a low coefficient of friction material surrounding a corrugated steel core reinforcement element.

11. The slide assembly of claim 1, wherein said first and second medial planes are inclined with respect to each other at an angle of approximately five degrees.

12. The slide assembly of claim 1, wherein said second corrugated surface includes plural spaced-apart corrugated portions to accommodate coupling different sized drawers.

13. The slide assembly of claim 1, wherein said cabinet-side member includes a stopper, a bottom portion of said intermediate member being disposed for engagement with said stopper for limiting the forward sliding movement of the intermediate member.

14. The slide assembly of claim 1, wherein said drawer-side member includes a tab portion engageable with a top portion of said intermediate member during forward drawer travel for moving the intermediate member together with the drawer-side member.

15. A slide assembly comprising:

a corrugated drawer-side member including a first corrugated surface;

a cabinet-side member including a second corrugated surface; and a corrugated intermediate member made from metal coated with a low coefficient of friction material, said intermediate member including a body having generally v-shaped corrugations along a portion thereof with said corrugations being sized and shaped for mateable sliding movement between said respective first and second corrugated surfaces.

16. The slide assembly of claim 15, wherein said metal is steel.

17. The slide assembly of claim 15, wherein said drawer-side member is one side of a drawer.

18. The slide assembly of claim 15, wherein said cabinet-side member includes plural spaced-apart corrugated portions to accommodate coupling different sized drawers.

19. The slide assembly of claim 15, wherein said cabinet-side member includes a stopper, a bottom portion of said intermediate member being disposed for engagement with said stopper for limiting the forward sliding movement of the intermediate member.

20. The slide assembly of claim 15, wherein said drawer-side member includes a tab portion engageable with a top portion of said intermediate member during forward drawer travel for moving the intermediate member together with the drawer-side member.

* * * * *